US007401684B2

(12) United States Patent
Fujita

(10) Patent No.: US 7,401,684 B2
(45) Date of Patent: Jul. 22, 2008

(54) AUTOMATIC ANNOUNCING DEVICE FOR AN ELEVATOR

(75) Inventor: Masao Fujita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 472 days.

(21) Appl. No.: 10/552,922

(22) PCT Filed: Jul. 8, 2004

(86) PCT No.: PCT/JP2004/009712

§ 371 (c)(1),
(2), (4) Date: Oct. 11, 2005

(87) PCT Pub. No.: WO2006/006204

PCT Pub. Date: Jan. 19, 2006

(65) Prior Publication Data

US 2007/0107992 A1 May 17, 2007

(51) Int. Cl.
*B66B 1/34* (2006.01)

(52) U.S. Cl. ..... 187/391; 187/396

(58) Field of Classification Search ..... 187/380–389, 187/391–398, 247, 313, 901; 340/945
See application file for complete search history.

(56) References Cited

U.S. PATENT DOCUMENTS

| | | | | |
|---|---|---|---|---|
| 4,032,882 | A * | 6/1977 | Mandel et al. | 187/398 |
| 6,902,041 | B2 * | 6/2005 | Eccleston | 187/380 |
| 2007/0273556 | A1 * | 11/2007 | Gyde et al. | 340/945 |

FOREIGN PATENT DOCUMENTS

| | | | |
|---|---|---|---|
| JP | 02169480 | A * | 6/1990 |
| JP | 4-358676 | | 12/1992 |
| JP | 04358676 | A * | 12/1992 |
| JP | 05-116853 | | 5/1993 |
| JP | 06144730 | A * | 5/1994 |
| JP | 8-73141 | | 3/1996 |
| JP | 2001-002336 | | 1/2001 |
| JP | 2001-354367 | | 12/2001 |

* cited by examiner

*Primary Examiner*—Jonathan Salata
(74) *Attorney, Agent, or Firm*—Leydig, Voit & Mayer, Ltd.

(57) ABSTRACT

An automatic announcing device for an elevator which enables fine voice volume adjustment according to the environment of use in which a guidance announcement is made and which allows an easy and efficient voice volume adjustment operation. The automatic announcing device for an elevator includes: a voice volume adjustment setting unit for setting a predetermined condition for voice volume adjustment; a control unit for outputting a control code in accordance with the condition set by the voice volume adjustment setting unit to set an operation mode of the elevator to a voice volume adjustment operation until completion of the voice volume adjustment, and for outputting a voice volume code in accordance with the condition set by the voice volume adjustment setting unit; a voice volume change amount indicating unit for indicating an amount of voice volume change in accordance with the voice volume code output from the control unit; and a voice volume data storing unit for storing voice volume data in accordance with kind or timing of a message, the voice volume of a message changing based on the voice volume data, in accordance with the control code and the voice volume code from the control unit and stored in the voice volume data storing unit.

4 Claims, 9 Drawing Sheets

FIG. 2

| CONTROL CODE | CODE NUMBER | CONTENTS |
|---|---|---|
| CD | 0000 0000 | VOICE VOLUME ADJUSTMENT INVALIDATING COMMAND |
| CCa | 0001 0000 | COLLECTIVE VOICE VOLUME ADJUSTMENT COMMAND |
| CCdcg | 0001 0001 | DAYTIME DOOR-CLOSED CONDITION NORMAL ANNOUNCEMENT INDIVIDUAL VOICE VOLUME ADJUSTMENT COMMAND |
| CCncg | 0001 0010 | NIGHTTIME DOOR-CLOSED CONDITION NORMAL ANNOUNCEMENT INDIVIDUAL VOICE VOLUME ADJUSTMENT COMMAND |
| CCdog | 0001 0011 | DAYTIME DOOR-OPENED CONDITION NORMAL ANNOUNCEMENT INDIVIDUAL VOICE VOLUME ADJUSTMENT COMMAND |
| CCnog | 0001 0100 | NIGHTTIME DOOR-OPENED CONDITION NORMAL ANNOUNCEMENT INDIVIDUAL VOICE VOLUME ADJUSTMENT COMMAND |
| CCdce | 0001 0101 | DAYTIME DOOR-CLOSED CONDITION EMERGENCY ANNOUNCEMENT INDIVIDUAL VOICE VOLUME ADJUSTMENT COMMAND |
| CCnce | 0001 0110 | NIGHTTIME DOOR-CLOSED CONDITION EMERGENCY ANNOUNCEMENT INDIVIDUAL VOICE VOLUME ADJUSTMENT COMMAND |
| CCdoe | 0001 0111 | DAYTIME DOOR-OPENED CONDITION EMERGENCY ANNOUNCEMENT INDIVIDUAL VOICE VOLUME ADJUSTMENT COMMAND |
| CCnoe | 0001 1000 | NIGHTTIME DOOR-OPENED CONDITION EMERGENCY ANNOUNCEMENT INDIVIDUAL VOICE VOLUME ADJUSTMENT COMMAND |
| CCdb | 0001 1001 | DAYTIME CRIME-PREVENTION BUZZER INDIVIDUAL VOICE VOLUME ADJUSTMENT COMMAND |
| CCnb | 0001 1010 | NIGHTTIME CRIME-PREVENTION BUZZER INDIVIDUAL VOICE VOLUME ADJUSTMENT COMMAND |

FIG. 3

| VOICE VOLUME CODE | CODE NUMBER | CONTENTS |
|---|---|---|
| V1u | 1000 0001 | 1dB-INCREASE COMMAND |
| V2u | 1000 0010 | 2dB-INCREASE COMMAND |
| V3u | 1000 0011 | 3dB-INCREASE COMMAND |
| I | I | I |
| V10u | 1000 1010 | 10dB-INCREASE COMMAND |
| I | I | I |
| V1d | 1001 0001 | 1dB-DECREASE COMMAND |
| V2d | 1001 0010 | 2dB-DECREASE COMMAND |
| V3d | 1001 0011 | 3dB-DECREASE COMMAND |
| I | I | I |
| V10d | 1001 1010 | 10dB-DECREASE COMMAND |
| I | I | I |

FIG. 4

| VOICE VOLUME DATA | CONTENTS |
|---|---|
| Mdcg | DAYTIME DOOR-CLOSED CONDITION NORMAL ANNOUNCEMENT VOICE VOLUME DATA |
| Mncg | NIGHTTIME DOOR-CLOSED CONDITION NORMAL ANNOUNCEMENT VOICE VOLUME DATA |
| Mdog | DAYTIME DOOR-OPENED CONDITION NORMAL ANNOUNCEMENT VOICE VOLUME DATA |
| Mnog | NIGHTTIME DOOR-OPENED CONDITION NORMAL ANNOUNCEMENT VOICE VOLUME DATA |
| Mdce | DAYTIME DOOR-CLOSED CONDITION EMERGENCY ANNOUNCEMENT VOICE VOLUME DATA |
| Mnce | NIGHTTIME DOOR-CLOSED CONDITION EMERGENCY ANNOUNCEMENT VOICE VOLUME DATA |
| Mdce | DAYTIME DOOR-OPENED CONDITION EMERGENCY ANNOUNCEMENT VOICE VOLUME DATA |
| Mnce | NIGHTTIME DOOR-OPENED CONDITION EMERGENCY ANNOUNCEMENT VOICE VOLUME DATA |
| Mdb | DAYTIME CRIME-PREVENTION BUZZER VOICE VOLUME DATA |
| Mnb | NIGHTTIME CRIME-PREVENTION BUZZER VOICE VOLUME DATA |

FIG. 5

| ANNOUNCE-MENT CODE | CODE NUMBER | MESSAGE | VOICE VOLUME DATA | TIME OF DAY |
|---|---|---|---|---|
| M1 | 1000 0001 | PRESS DESTINATION BUTTON. | Mdcg | DAYTIME |
| | | | Mncg | NIGHTTIME |
| M2 | 1000 0010 | ELEVATOR IS VERY CROWDED. YOUR PATIENCE FOR A WHILE IS APPRECIATED. | Mdcg | DAYTIME |
| | | | Mncg | NIGHTTIME |
| M3 | 1000 0011 | ELEVATOR WILL DESCEND. | Mdog | DAYTIME |
| | | | Mnog | NIGHTTIME |
| M4 | 1000 0100 | ELEVATOR WILL ASCEND. | Mdog | DAYTIME |
| | | | Mnog | NIGHTTIME |
| M5 | 1000 0101 | EARTHQUAKE: PLEASE GET OFF ONCE DOOR IS OPEN. | Mdce | DAYTIME |
| | | | Mnce | NIGHTTIME |
| M6 | 1000 0110 | FIRE: PLEASE GET OFF ONCE DOOR IS OPEN | Mdce | DAYTIME |
| | | | Mnce | NIGHTTIME |
| M7 | 1000 0111 | BZZ X N TIMES (CRIME-PREVENTION BUZZER SOUND) | Mdb | DAYTIME |
| | | | Mnb | NIGHTTIME |

FIG. 9

| ANNOUNCE-MENT CODE | CODE NUMBER | MESSAGE | VOICE VOLUME DATA | TIME OF DAY |
|---|---|---|---|---|
| M1 | 1000 0001 | ASCENDING ELEVATOR IS COMING. | Mdcg | DAYTIME |
| | | | Mncg | NIGHTTIME |
| M2 | 1000 0010 | DESCENDING ELEVATOR IS COMING. | Mdcg | DAYTIME |
| | | | Mncg | NIGHTTIME |
| M3 | 1000 0011 | ELEVATOR WILL DESCEND. | Mdog | DAYTIME |
| | | | Mnog | NIGHTTIME |
| M4 | 1000 0100 | ELEVATOR WILL ASCEND. | Mdog | DAYTIME |
| | | | Mnog | NIGHTTIME |
| M5 | 1000 0101 | ELEVATOR IS OUT OF SERVICE NOW. | Mdce | DAYTIME |
| | | | Mnce | NIGHTTIME |
| | | | | |
| | | | | |
| M7 | 1000 0111 | BZZ X N TIMES (CRIME-PREVENTION BUZZER SOUND) | Mdb | DAYTIME |
| | | | Mnb | NIGHTTIME |

AUTOMATIC ANNOUNCING DEVICE FOR AN ELEVATOR

TECHNICAL FIELD

The present invention relates to an automatic announcing device for an elevator, in particular, an automatic announcing device for an elevator for adjusting the voice volume of an announcement.

BACKGROUND ART

Conventionally, there is an automatic announcing device for an elevator with which the voice volume of an announcement is adjusted by adjusting the gain of an amplifier for amplifying the voice with an operation switch inside a car (see, for example, Patent Document 1).

Patent Document 1: JP 05-116853 A

DISCLOSURE OF THE INVENTION

Problem to be Solved by the Invention

However, with the automatic announcing device for an elevator described above, in which the gain of the amplifier is changed by establishing a predetermined condition through operation of the operation switch or button inside the car, all messages can be adjusted only to the same voice volume, which disadvantageously makes it impossible to perform fine voice volume adjustment according to the kind of a message or the environment of use in which a guidance announcement is made.

The present invention has been made to solve the above-mentioned problem, and therefore it is an object of the present invention to provide an automatic announcing device for an elevator which enables fine voice volume adjustment according to the environment of use in which a guidance announcement is made and which allows a voice volume adjusting operation to be performed with ease and efficiency.

Means for Solving the Problem

An automatic announcing device for an elevator according to the present invention relates to an automatic announcing device for an elevator equipped with an announcing device for announcing a message in accordance with an operation status of an elevator, including: voice volume adjustment setting means for setting a predetermined condition for voice volume adjustment; control means for outputting a control code in accordance with the condition set by the voice volume adjustment setting means to set an operation mode of the elevator to a voice volume adjustment operation until completion of the voice volume adjustment, and for outputting a voice volume code in accordance with the condition set by the voice volume adjustment setting means; and voice volume change amount indicating means for indicating an amount of voice volume change in accordance with the voice volume code output from the control means, the announcing device being characterized in that: the announcing device includes voice volume data storing means for storing voice volume data in accordance with a kind or timing of a message; and the announcing device changes a voice volume of a message based on the voice volume data in accordance with the control code and the voice volume code from the control means and stored in the voice volume data storing means.

Effect of the Invention

According to the present invention, fine voice volume adjustment can be performed according to the environment of use in which a guidance announcement is made, whereby a voice volume adjustment operation can be performed with ease and efficiency.

BRIEF DESCRIPTION OF THE DRAWINGS

FIG. 2 is a chart showing the contents of control codes for voice volume adjustment which are output from an operation control device 1 shown in FIG. 1 to an announcing device 21.

FIG. 3 is a chart showing the contents of voice volume codes for designating the amount of voice volume change during voice volume adjustment which are output from the operation control device 1 shown in FIG. 1 to the announcing device 21.

FIG. 4 is a chart showing the contents of a voice volume data memory 24 of the announcing device 21 shown in FIG. 1.

FIG. 5 is a chart showing the relationships between messages announced by the announcing device 21 shown in FIG. 1 and voice volume data.

FIG. 9 is a chart showing the relationships between messages announced by the announcing device 21 shown in FIG. 8, which is installed at a hall, and voice volume data.

BEST MODE FOR CARRYING OUT THE INVENTION

Embodiment 1

Figure 1:
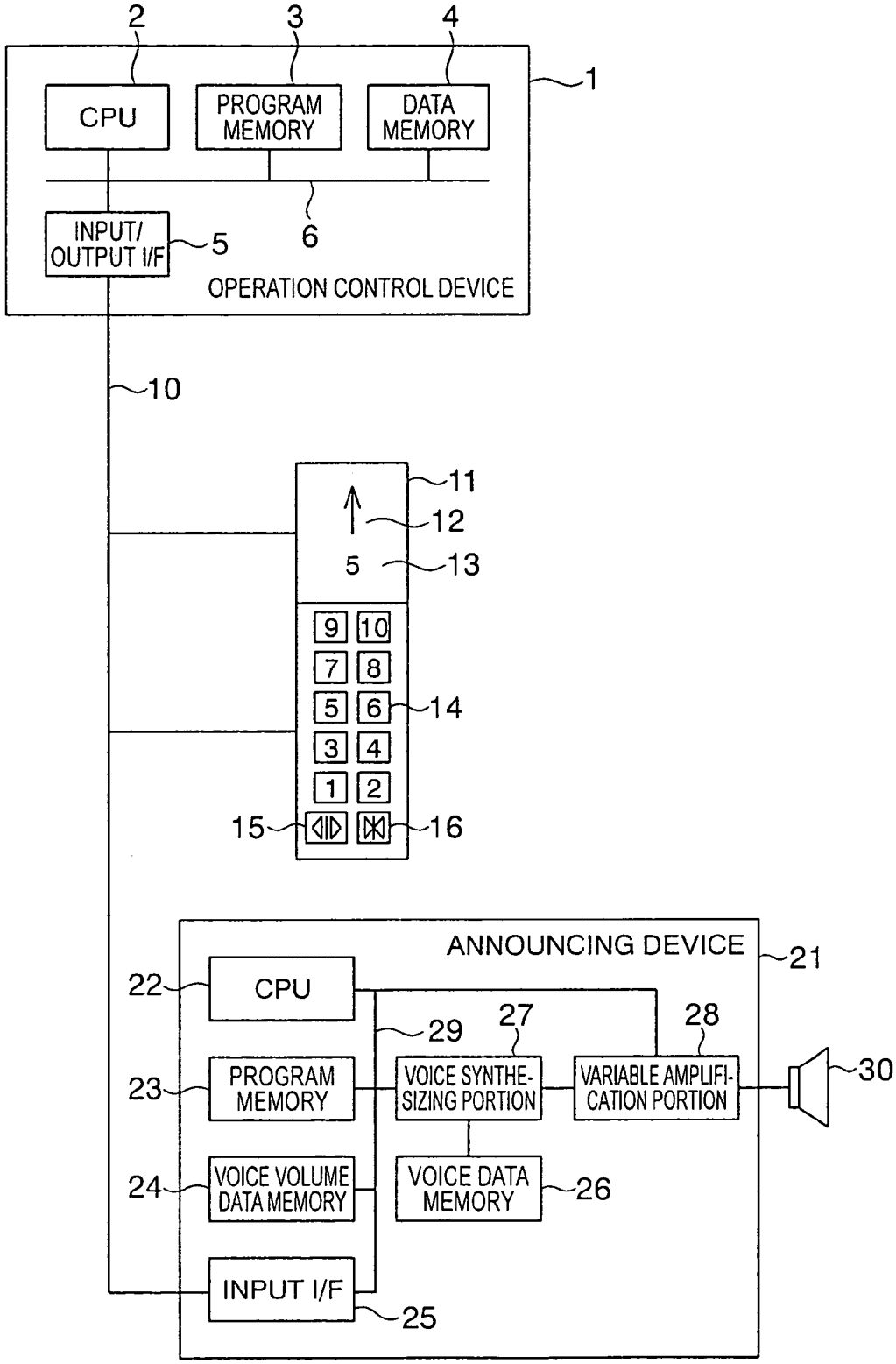
FIG. 1 is a block diagram showing the configuration of an automatic announcing device for an elevator according to Embodiment 1 of the present invention.

FIG. 1 is a block diagram showing the configuration of an automatic announcing device for an elevator according to Embodiment 1 of the present invention. An operation control device 1, which serves as control means for performing control on the overall operation of an elevator and on the announcement voice volume, is composed of a CPU 2 for performing computation and data processing, a program memory 3 having a built-in program, a data memory 4 for temporarily storing the computation results and the like, an input/output interface 5 for performing inputting/outputting of a signal to/from external equipment, and a bus 6 connecting those components to each other. The operation control device 1 is adapted to perform data transmission between a car operation panel 11 and an announcing device 21 via a transmission path 10.

The car operation panel 11 is provided inside the car, and is composed of a direction lamp 12 indicating the running direction of the car, a floor indicator 13 indicating the current position of the car, destination buttons 14 for registering destination floors, a door opening button 15, and a door closing button 16. Here, the buttons 14 through 16 constitute voice volume adjustment setting means for establishing a predetermined condition for voice volume adjustment. Further, the direction lamp 12 and the floor indicator 13 are collectively referred to as the indicator, and this indicator is used to indicate the amount of change in voice volume.

The announcing device 21 is used for announcing a message according to the operation of the elevator via a speaker 30 provided inside the car. The announcing device 21 is composed of a CPU 22 for performing computation and data processing, a program memory 23 having a built-in program, a voice volume data memory 24 as voice volume data storing means for storing voice volume data according to the kind or timing of a message, an input interface 25 for inputting data output from the operation control device 1, a voice data memory 26 for storing voice data and pseudo-voice data, a voice synthesizing portion 27 for converting the voice data read out from the voice data memory 26 into an analog signal, a variable amplification portion 28 for making variable the gain for amplifying the voice volume according to the value of the voice volume data memory 24, and a bus 29 connecting those components to each other.

It should be noted that a memory capable of retaining data even when power is cut off, for example, a nonvolatile memory such as EEPROM or a battery backed-up RAM, is employed as the voice volume data memory 24, and that an electronic voice volume that can be controlled by the CPU 22 is employed as the variable amplification portion 28.

FIG. 2 is a chart showing the contents of control codes for voice volume adjustment which are output from the operation control device 1 to the announcing device 21. For example, the code number for the control code "CCdcg" is "0001 0001", and the content of the control code is "daytime door-closed condition normal announcement individual voice volume adjustment command". Here, the individual voice volume adjustment command allows individual adjustment according to the announcement content (normal announcement/emergency announcement/crime-prevention buzzer), the announcement target (announcement made to passengers in the car while the door is closed/announcement made to passengers in the car or to passengers waiting at the hall while the door is open), and the time of day (daytime/nighttime).

Further, FIG. 3 is a chart showing the contents of voice volume codes output from the operation control device 1 to the announcing device 21, for designating the amount of voice volume change upon voice volume adjustment. For example, the code number for the voice volume code "Vlu" is "1000 0001", and the content of the voice volume code is "1 dB-increase command".

Further, FIG. 4 is a chart showing the contents of the voice volume data memory 24 of the announcing device 21. For example, the content of the voice volume data "Mdcg" is "daytime door-closed condition normal announcement voice volume data".

Further, FIG. 5 is a chart showing the relationships between messages announced by the announcing device 21 and the voice volume data. For example, the message corresponding to the code number "1000 0001" of the announcement code "M1" that is output from the operation control device 1 to the announcing device 21 is "Press destination button.", which is stored in advance as voice data in the voice data memory 26 of the announcing device 21. The chart shows that this message is announced by using the voice volume data "Mdcg" or "Mncg" depending on the time of day.

Referring to FIGS. 2, 3, and 5, the control codes, the voice volume codes, and the announcement codes are output from the operation control device 1 to the announcing device 21 via the transmission path 10. The code numbers are assigned such that they do not overlap between the control codes and the announcement codes. The code numbers are also assigned such that they do not overlap between the control codes and the voice volume codes, whereas the code numbers assigned may overlap between the announcement codes and the voice volume codes.

Further, as shown in FIG. 5, the announcing device 21 is adapted to select the optimal voice volume for each message according to the announcement content (normal announcement/emergency announcement/crime-prevention buzzer), the announcement target (announcement made to passengers in the car while the door is closed/announcement made to passengers in the car or to passengers waiting at the hall while the door is open), and the time of day (daytime/nighttime). It should be noted that the selection of the time of day (daytime/nighttime) is realized by a timer (not shown) built in the operation control device 1 or in the announcing device 21.

Figure 6:
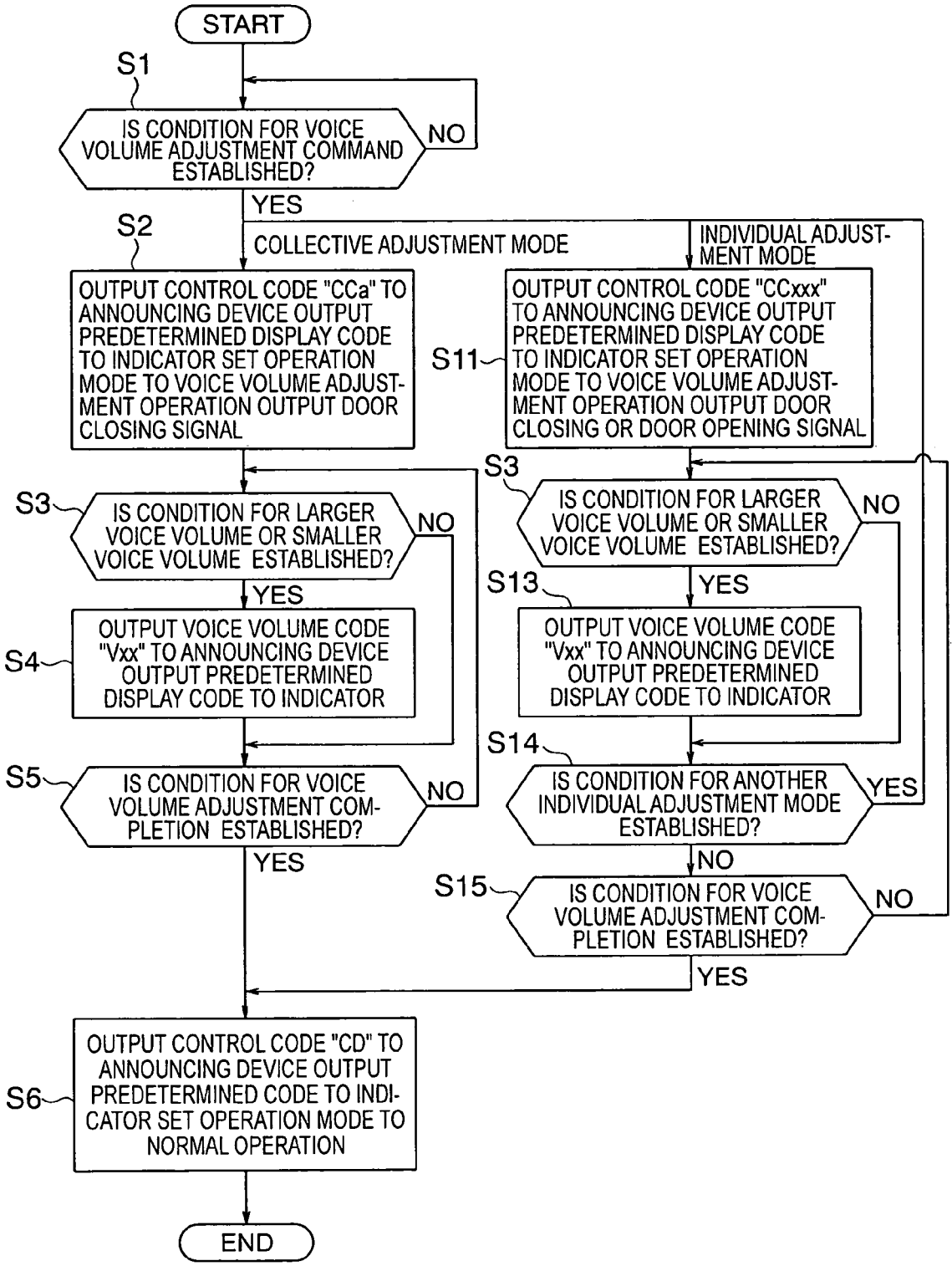
FIG. 6 is an operation flow chart showing how voice volume adjustment is performed on the announcing device 21 by the operation control device 1 shown in FIG. 1.

Next, description will be made on how the automatic announcing device for an elevator according to Embodiment 1 operates. First, referring to the flowchart shown in FIG. 6, description will be made on the operation in the case where voice volume adjustment is performed on the announcing device 21 by the operation control device 1. Referring to FIG. 6, in step S1, a determination is made as to whether or not a predetermined condition for voice volume adjustment has been established. The predetermined condition is generated by operating the destination buttons 14, the door opening button 15, and the door closing button 16, which are incorporated into the car operation panel 11, under a preset condition, and by sending the resulting signal via the transmission path 10 to the operation control device 1 for data processing. For instance, when, after continuously pressing the door opening button 15 and the door closing button 16 at the same time for 10 seconds or more, the door closing button 15 is pressed continuously for 10 seconds or more, it is determined that a collective adjustment mode has been selected. When, after continuously pressing the door opening button 15 and the door closing button 16 at the same time for 10 seconds or more, a specific destination button 14 is pressed continuously for 10 seconds or more, it is determined that an individual adjustment mode has been selected.

Here, the collective adjustment mode refers to a mode in which adjustment is performed on voice volume under a certain specific condition, and adjustment on the voice volume under conditions other than the above condition is performed through calculation based on the adjusted value obtained above. According to this mode, for example, adjustment is performed only on the daytime door-closed condition normal announcement voice volume data corresponding to the voice volume data "Mdcg" shown in FIG. 5, and adjustment on other voice volume data is performed through calculation based on the value of the voice volume data "Mdcg". On the other hand, the individual adjustment mode refers to a mode in which voice volumes under respective conditions are individually adjusted. According to this mode, for example, individual adjustment is performed on the voice volume data "Mdcg", "Mcng", or the like shown in FIG. 5. When the condition for designating the collective adjustment mode is established, the operation proceeds to step S2, and when the condition for designating the individual adjustment mode is established, the operation proceeds to step S11.

In step S2, to switch the operation of the announcing device 21 to the collective adjustment mode, the control code "CCa" shown in FIG. 2 is output to the announcing device 21, and a display code for performing a predetermined display on the indicator of the car operation panel 11 is output so that an operator performing button operations inside the car can confirm that the operation has been switched to the collective adjustment mode. For example, a display code for effecting flashing display of a special symbol on the floor indicator 13 is output to the car operation panel 11. Further, the operation of the elevator is switched from normal operation to voice volume adjustment operation to thereby disable responses to operations on the car or hall buttons, and also a door closing signal is output to a door device (not shown) to close the door. The series of operations described above complete the preparations for adjusting the daytime door-closed condition normal announcement voice volume data.

In step S3, it is determined whether or not a predetermined condition for increasing or decreasing the voice volume has been established. The predetermined condition is generated by operating the destination buttons 14, the door opening button 15, and the door closing button 16, which are incorporated into the car operation panel 11, under a preset condition, and by sending the resulting signal via the transmission path 10 to the operation control device 1 for data processing. For example, when the door opening button is pressed once, it is determined that the voice volume is to be increased by 1 dB (decibel), and when the door closing button is pressed once, it is determined that the voice volume is to be decreased by 1 dB. Alternatively, by combining this operation with the operation on the floor button, the voice volume may be increased or decreased by an amount equal to the numerical number of the floor button. For example, the voice volume may be increased by 5 dB when the door closing button is pressed once after pressing the fifth-floor button.

When the predetermined condition for increasing or decreasing the voice volume has been established, the operation proceeds to step S4, the voice volume code shown in FIG. 3 which is designated through button operation by the operator is output to the announcing device 21, and a display code for effecting a predetermined display on the indicator of the car operation panel 11 is output so that the operator performing button operations inside the car can confirm the amount of voice volume change. For example, the direction lamp 12 is caused to indicate an increase/decrease in the voice volume by means of an upward/downward arrow, and a display code for displaying the amount of voice volume change on the floor indicator 13 is output to the car operation panel 11. For instance, under a setting where the voice volume is to be increased by 5 dB, the direction lamp 12 indicates an upward arrow, and "5" is displayed on the floor indicator 13.

In step S5, it is judged whether or not a predetermined condition for completing the voice volume adjustment has been established. The predetermined condition is generated by operating the destination buttons 14, the door opening button 15, and the door closing button 16, which are incorporated into the car operation panel 11, under a preset condition, and by sending the resulting signal via the transmission path 10 to the operation control device 1 for data processing. For example, the voice volume adjustment is determined to have been completed when the door closing button 16 is pressed continuously for 10 seconds or more.

When the predetermined condition for designating the completion of voice volume adjustment has been established, the operation proceeds to step S6, and the control code "CD" shown in FIG. 2 is output to the announcing device 21 in order to switch the operation of the announcing device 21 to the normal mode, and further a display code for effecting a predetermined display on the indicator of the car operation panel 11 is output so that the operator performing button operations inside the car can confirm the switching of the operation to the normal mode. For example, a display code for effecting flashing display of a special symbol on the floor indicator 13 is output to the car operation panel 11. Further, the operation of the elevator is returned to the normal operation service by switching it from the voice volume adjustment operation to the normal operation.

It should be noted that the difference between the processing from step S11 through step S15 for performing voice volume adjustment according to the individual adjustment mode from the processing according to the collective adjustment mode resides in the ability to designate a specific control code from among the control codes "CCdcg" through "CCnb" shown in FIG. 2. For example, when, after continuously pressing the door opening button 15 and the door closing button 16 at the same time for 10 seconds or more, the first-floor button of the destination buttons 14 is continuously pressed for 10 seconds or more, it is determined that a daytime door-closed condition normal announcement individual voice volume command, indicated by "CCdcg", has been selected. When, after continuously pressing the door opening button 15 and the door closing button 16 at the same time for 10 seconds or more, the "third-floor" button of the destination buttons 14 is continuously pressed for 10 seconds or more, it is determined that a daytime door-opened condition normal announcement individual voice volume command, indicated by "CCdog", has been selected.

Further, in step S11, the door opening/closing is controlled according to the object of the voice volume adjustment. For instance, in the case of the control code "CCdog", a door opening signal is output to the door device (not shown) to open the door, thereby enabling the voice volume adjustment. Further, as shown in step 14, another difference from the processing according to the collective adjustment mode is that after the voice volume adjustment on one voice volume data is completed, the voice volume adjustment on another voice volume data can be continuously performed.

Figure 7:
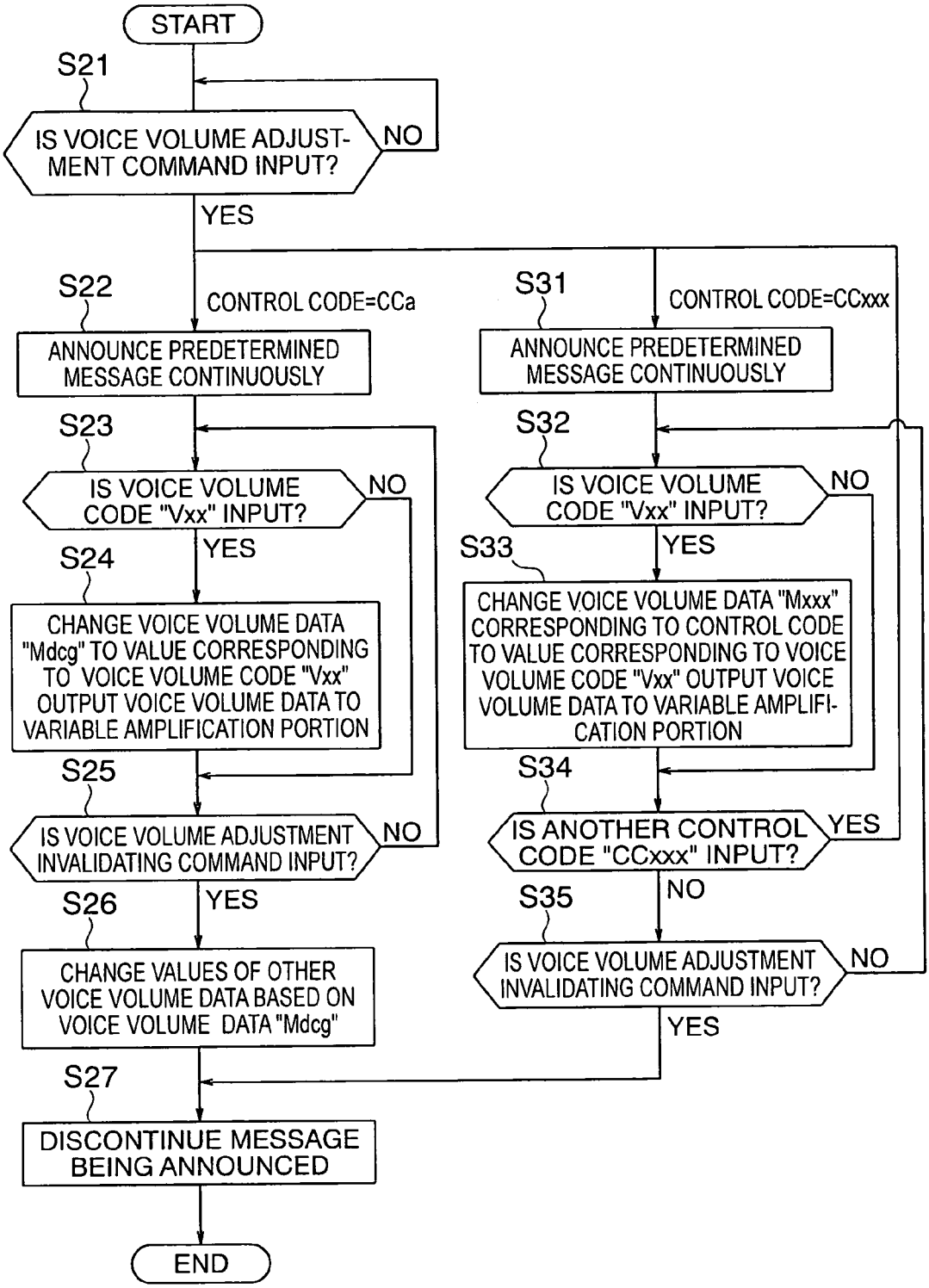
FIG. 7 is a flow chart showing how the announcing device 21 shown in FIG. 1 operates during voice volume adjustment.

Next, with reference to the flow chart of FIG. 7, description will be made on how the announcing device 21 operates during voice volume adjustment. Referring to FIG. 7, in step S21, a determination is made as to whether or not a voice volume adjusting command output from the operation control device 1 has been input. This is an operation corresponding to step S2 or step S11 of FIG. 6. When the control code "CCa" designating the collective adjustment mode is input, the operation proceeds to step S22 where a sample message for confirming the daytime door-closed condition normal announcement voice volume is continuously announced. For example, a message corresponding to the announcement code "M1" shown in FIG. 5 is continuously announced.

In step S23, it is determined whether or not the voice volume code output from the operation control device 1 has been input. This is an operation corresponding to step S4 of FIG. 6.

In step S24, the daytime door-closed condition normal announcement voice volume data is changed to the voice volume data that corresponds to the voice volume code, and the resultant voice volume data is output to the variable amplification portion for performing an announcement at the changed voice volume. The operator inside the car confirms the announcement at this voice volume, thus making it possible to judge whether or not voice volume adjustment is necessary.

In step S25, a determination is made as to whether or not a voice volume adjustment invalidating signal output from the operation control device 1 has been input. This is an operation corresponding to step S6 of FIG. 6. When the voice volume adjustment invalidating signal is input, the operation proceeds to step S26 where, based on the daytime door-closed condition normal announcement voice volume data "Mdcg" that has been adjusted, the other voice volume data from "Mncg" through "Mnb" are calculated through computation and changed in their values. For example, the voice volume data "Mncg" and "Mdcg" are used at different times of day, so the computation is performed for setting the value of the voice volume data "Mncg" used at nighttime to ⅗ of the value of the voice volume data "Mdcg" used at daytime.

Further, in step S27, the sample message being announced is discontinued, and a series of operations according to the collective adjustment mode are completed.

It should be noted that the difference of the processing from step S31 through step S35 for performing voice volume adjustment according to the individual adjustment mode from the processing according to the collective adjustment mode resides in the ability to change specific voice volume data from among the voice volume data "Mdcg" through "Mnb" shown in FIG. 4. Further, as shown in step S34, another difference from the processing according to the collective adjustment mode is that after the voice volume adjustment on one voice volume data is completed, the voice volume adjustment on another voice volume data can be continuously performed.

As described above, according to Embodiment 1, individual voice volume adjustment can be performed according to the announcement content (normal announcement/emergency announcement/crime-prevention buzzer), the announcement target (announcement made to passengers in the car while the door is closed/announcement made to passengers in the car and to passengers waiting at the hall while the door is open), and the time of day (daytime/nighttime), thereby enabling fine voice volume adjustment according to the environment of use in which a guidance announcement is made.

Further, voice volume adjustment can be effected through button operations on the car operation panel, and the process of the voice volume adjustment is displayed on the indicator inside the car, whereby the operator can perform the voice volume adjustment operation with ease and efficiency.

Embodiment 2

Figure 8:
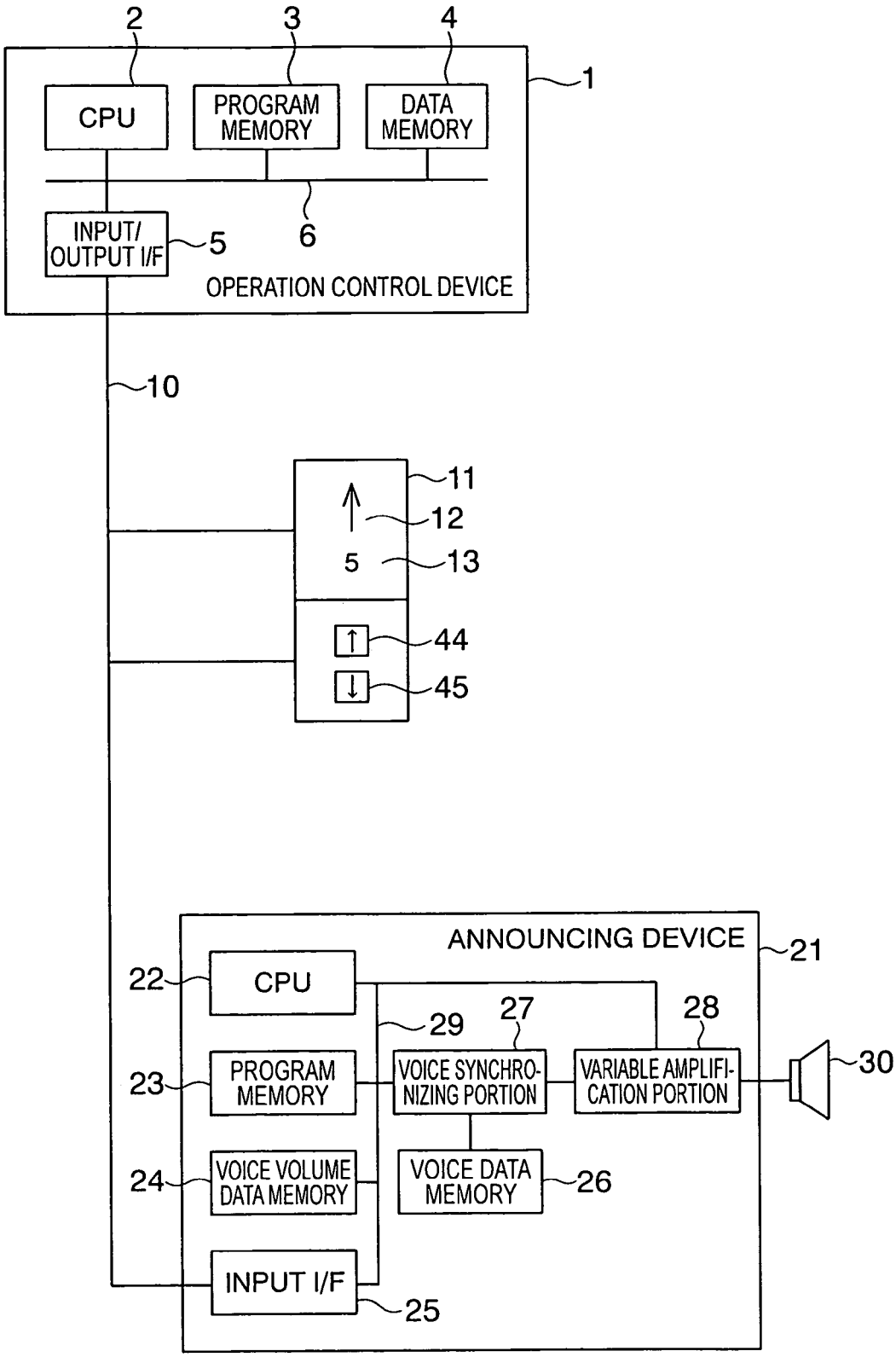
FIG. 8 is a block diagram showing the configuration of an automatic announcing device for an elevator according to Embodiment 2 of the present invention.

FIG. 8 is a block diagram showing the configuration of an automatic announcing device for an elevator according to Embodiment 2 of the present invention. In Embodiment 2 shown in FIG. 8, the portions that are identical to those of the structure according to Embodiment 1 shown in FIG. 1 are denoted by the same reference numerals and detailed description thereof will be omitted. The structural difference from Embodiment 1 resides in that a hall operation panel 41 is used in place of the car operation panel 11 shown in FIG. 1 and that the announcing device 21 is installed at the hall.

That is, in Embodiment 2, the hall operation panel 41 is composed of a direction lamp 42 for indicating the running direction of the car, a floor indicator 43 for indicating the current position of the car, an upward pushbutton 44, and a downward pushbutton 45. Here, the buttons 44 and 45 constitute voice volume adjustment setting means for establishing a predetermined condition for effecting voice volume adjustment. Further, the direction lamp 42 and the floor indicator 43 are collectively referred to as the indicator, and this indicator is used to indicate the amount of change in voice volume.

Further, FIG. 9 is a chart showing the relationship between messages announced by the announcing device 21 installed at the hall and voice volume data.

Referring to FIG. 9, the announcing device 21 installed at the hall is adapted to select the optimal voice volume for each message according to the announcement content (normal announcement/emergency announcement/crime-prevention buzzer), the announcement target (announcement made to passengers in the car while the door is closed/announcement made to passengers in the car and to passengers waiting at the hall while the door is open), and the time of day (daytime/nighttime). It should be noted that the selection of the time of day (daytime/nighttime) is realized by a timer (not shown) built in the operation control device 1 or the announcing device 21.

The automatic announcing device for an elevator according to Embodiment 2 operates in the same manner as illustrated in the flow chart according to Embodiment 1 shown in FIGS. 6 and 7. The only difference is that the button operations on the car operation panel are changed to button operations on the hall operation panel; otherwise, Embodiment 2 is of basically the same configuration as Embodiment 1.

Therefore, according to Embodiment 2 as well, individual voice volume adjustment can be performed according to the announcement content (normal announcement/emergency announcement/crime-prevention buzzer),. the announcement target (announcement made to passengers in the car while the door is closed/announcement made to passengers in the car and to passengers waiting at the hall while the door is open), and the time of day (daytime/nighttime), thereby enabling fine voice volume adjustment according to the environment of use in which a guidance announcement is made.

Further, voice volume adjustment can be effected through button operations on the hall operation panel, and the process of voice volume adjustment is displayed on the indicator inside the car, whereby the operator can perform the voice volume adjustment operation with ease and efficiency.

INDUSTRIAL APPLICABILITY

According to the present invention, individual voice volume adjustment can be performed according to the announcement content, time of day, or the like, thereby making it possible to provide an automatic announcing device for an elevator which enables fine voice volume adjustment according to the environment of use in which a guidance announcement is made.

The invention claimed is:

1. An automatic announcing device for an elevator equipped with an announcing device for announcing a message based on operation status of the elevator, comprising:

voice volume adjustment setting means for setting a predetermined condition for voice volume adjustment;

control means for outputting a control code in accordance with the condition set by the voice volume adjustment setting means to set an operation mode of the elevator to a voice volume adjustment operation, until completion of the voice volume adjustment, and for outputting a voice volume code in accordance with the condition set by the voice volume adjustment setting means;

voice volume change amount indicating means for indicating amount of voice volume change in accordance with the voice volume code output from the control means; and voice volume data storing means for storing voice volume data in accordance with a kind or timing of a message, wherein voice volume of a message changes based on the voice volume data in accordance with the control code and the voice volume code from the control means and stored in the voice volume data storing means.

2. The automatic announcing device for an elevator according to claim 1, wherein:

the voice volume adjustment setting means comprises a car operation panel including a plurality of buttons, the predetermined condition for voice volume adjustment being set through operation on the buttons; and the voice volume change amount indicating means is an indicator of the car operation panel.

3. The automatic announcing device for an elevator according to claim 1, wherein:

the voice volume adjustment setting means comprises a hall operation panel including a plurality of buttons, the predetermined condition for voice volume adjustment being set through operation on the buttons; and the voice volume change amount indicating means is an indicator of the hall operation panel.

4. The automatic announcing device for an elevator according to claim 1, wherein the voice volume data storing means stores a plurality of different pieces of voice volume data according to at least content of an announcement, a target person to whom an announcement is directed, and time of an announcement.

* * * * *